United States Patent [19]

Dunn et al.

[11] Patent Number: 4,589,119

[45] Date of Patent: May 13, 1986

[54] ELECTRODE SUPPORT MECHANISM AND METHOD

[75] Inventors: Charles S. Dunn, Pataskala; Stephen Seng, Frazeysburg, both of Ohio

[73] Assignee: Owens-Corning Fiberglas Corporation, Toledo, Ohio

[21] Appl. No.: 561,863

[22] Filed: Dec. 16, 1983

Related U.S. Application Data

[63] Continuation-in-part of Ser. No. 342,870, Jan. 26, 1982, Pat. No. 4,422,172.

[51] Int. Cl.[4] ..... H05B 7/10

[52] U.S. Cl. ..... 373/94; 373/52; 373/99; 373/100; 373/101

[58] Field of Search ..... 373/94, 99, 100, 101, 373/98, 50–53, 105, 106

[56] References Cited

U.S. PATENT DOCUMENTS

| | | | |
|---|---|---|---|
| 1,892,109 | 12/1932 | Marshall . | |
| 2,911,455 | 11/1959 | Olsson et al. | 373/100 |
| 3,247,305 | 4/1966 | Allen . | |
| 3,898,364 | 8/1975 | Hardin . | |
| 4,075,414 | 2/1978 | Thomas . | |
| 4,182,927 | 1/1980 | Phillips . | |
| 4,194,078 | 3/1980 | Thomas . | |
| 4,397,028 | 8/1983 | Dunn et al. | 373/99 X |

FOREIGN PATENT DOCUMENTS 898528 6/1962 United Kingdom .

*Primary Examiner*—Roy N. Envall, Jr.
*Attorney, Agent, or Firm*—Ronald C. Hudgens; Patrick P. Pacella

[57] ABSTRACT

An apparatus for adjustably supporting a vertical electrode for an arc-type furnace. The apparatus includes an upper stationary electrode clamping structure and a lower adjustable electrode clamping structure suspended from the upper structure by adjustment screws. The two clamping structures are mounted on a carriage movable linearly into and out of registry with the furnace to accommodate maintenance and repair. Each clamping structure comprises an arcuate electrical contact and wedge-type slips engaging the periphery of the electrode in opposition to the electrical contact, the slips being spring-biased into electrode engagement and cam actuated from electrode engagement. The cams are actuated by a common shaft extending between the two clamping structures, so that the electrode is released from one clamping structure when engaged by the other clamping structure.

2 Claims, 7 Drawing Figures

ELECTRODE SUPPORT MECHANISM AND METHOD

This application is a continuation-in-part of our earlier U.S. application, Ser. No. 342,870, filed Jan. 26, 1982, now U.S. Pat. No. 4,422,172.

TECHNICAL FIELD

In the utilization of arc melting furnaces for the melting of basalt, glass batch, metals or the like, or for ore reduction, the charge to be melted is introduced in pulverant form into a furnace or crucible having a plurality of top-entering, vertically suspended electrodes. The electrodes typically are pre-baked, cylindrical carbon sections which are screwed together and which are consumed during the melting process.

The electrical current is supplied to the electrodes, typically three in number, from a transformer as the electrodes are individually suspended in the furnace or crucible for independent vertical displacement. The electrodes are individually adjusted vertically to maintain a constant voltage at each electrode-batch interface location, and the amperage varies as the resistance in the furnace changes.

The electrodes must be raised and lowered independently of one another with varying furnace operating conditions, e.g., as the resistance of the arc changes upon variations in the molten material level and the molten material temperature, as the electrode is consumed, and as cooler incoming raw materials are fed into the furnace. As a result, the electrodes are frequently moved up and down as they individually hunt for the desired balance point. Prior to the present invention, various forms of electrode supports have been proposed, but such supports have been cumbersome, expensive, non-positive electrode feeding means, which, for example, do not positively support the electrode independently of the electrode adjusting mechanism as the adjusting mechanism is reset due to electrode consumption.

RELATIONSHIP TO OTHER APPLICATIONS

In our earlier application Ser. No. 342,870, assigned to the assignee of this application, we disclosed an apparatus for and method of supporting an arc-type electrode. The present invention utilizes the method which we earlier disclosed but provides an improved apparatus for carrying out this method.

In the earlier-filed application Ser. No. 342,870, we disclosed the utilization of two parallel support arms for each electrode, the arms being cantilevered from a common vertical support parallel to the electrode. The arms were interconnected with an adjustment screw for vertically adjusting the lower arm relative to the upper arm. Each of the arms was provided with an electrode clamping mechanism, with the electrode at all times being clampingly engaged by at least one of the arms. Both of the arms were provided with electrical power supply means connected to a fixed pad carried by the arm and a spring-biased, semi-cylindrical clamping element which was spring biased into engagement with the electrode and movable from the electrode by power means.

The present invention does not utilize the vertically aligned cantilevered arms, which proved difficult to maintain in alignment, and the present invention provides an improved electrode clamping structure as well.

In another co-pending application, Ser. No. 342,672, filed in the United States Patent and Trademark Office on Jan. 26, 1982, and assigned to the assignee of this application, we disclosed an electrode replacement apparatus for threadedly assembling a replacement electrode onto the upper end of a working electrode. This apparatus utilized a clamping structure for the replacement electrode including a plurality of segmental, wedge-type slips engaging the periphery of the replacement electrode and forming a part of the mechanism for raising, lowering and rotating the replacement electrode during the replacement operation.

In U.S. Pat. No. 4,397,028, issued on Aug. 2, 1983 and assigned to the assignee of this invention, there is disclosed a variant on the structure of Ser. No. 342,870 in which the electrode clamping means at the ends of the cantilevered arms are actuated by cams interconnected by a common shaft. The cam orientation was such thaht the electrode is always clamped to one or the other of the arms.

BRIEF DESCRIPTION OF THE INVENTION

As hereinbefore explained, the present invention provides an improved apparatus for carrying out the method of operation disclosed in our co-pending patent application Ser. No. 342,870.

In the apparatus of the present invention, an electrode for an arc-type furnace is supported by a pair of superimposed support plates, the upper plate being relatively fixed in position and the lower plate being suspended from the upper plate and adjustable relative thereto by power means, such as jackscrews, interconnecting the two plates. The two support plates are mounted on a carriage which is linearly movable along a track. The carriage can be moved from its operating position superimposed over the furnace to a retracted position, thus exposing the furnace for maintenance and also facilitating maintenance of the apparatus of this invention.

The plates are provided with vertically aligned apertures through which the electrode projects vertically into the furnace, and each plate is provided with means for supplying the electrode with power current and for retaining the electrode in position. In the present invention, current is supplied to the electrode by an arcuate electrical contact plate fixed to each support plate and projecting into the electrode-receiving aperture. Each plate carries a plurality of vertically displaceable slips projecting into the electrode-receiving aperture in opposition to the contact plate. Each slip has an electrode-contacting face projecting into the aperture and an outer inclined face which contacts a similarly inclined actuating face fixed relative to the support plate. When the slip is in its lowered position, the inclined slip face urges the slip inwardly into contact with the electrode positioned in the aperture. Conversely, when each slip is elevated, its inclined face effects movement of the slip away from the electrode, thereby accommodating movement of the electrode relative to the associated support plate.

In the present invention, spring means are provided to constantly urge each of the slips downwardly so that the arcuate slip face engages the adjacent electrode, and each slip is movable upwardly against the bias of the spring means by cam means. The cam means for the upper plate and the cam means for the lower plate are mounted on a common cam shaft, and the cams are rotationally positioned relative to one another so that the slips of one plate will be raised (thereby releasing the electrode for movement) only when the slips of the other plate are engaging the electrode to retain it in position. To accommodate relative movement between the two plates, the cam carried by the lower movable plate is axially displaceable along the cam shaft.

By suspending the lower, movable plate from the upper, fixed plate, the present invention provides self-alignment between the electrode-receiving apertures in the plates thus eliminating any vertical alignment problems encountered in connection with the structure disclosed in our earlier application. Further, by providing the plurality of slips on each plate which are constantly spring-urged into engagement with the electrode, the present invention provides improved electrode retention, while the cam actuation of the slips to release the electrode for movement relative to either plate ensures that the electrode is constantly retained by one or the other plate.

In operation, the apparatus of the present invention carries out the method set forth in detail in our earlier application Ser. No. 342,870 and the same control mechanism (not shown) can be utilized in connection with the apparatus of the present invention.

DETAILED DESCRIPTION OF THE PREFERRED EMBODIMENT

Figure 1:
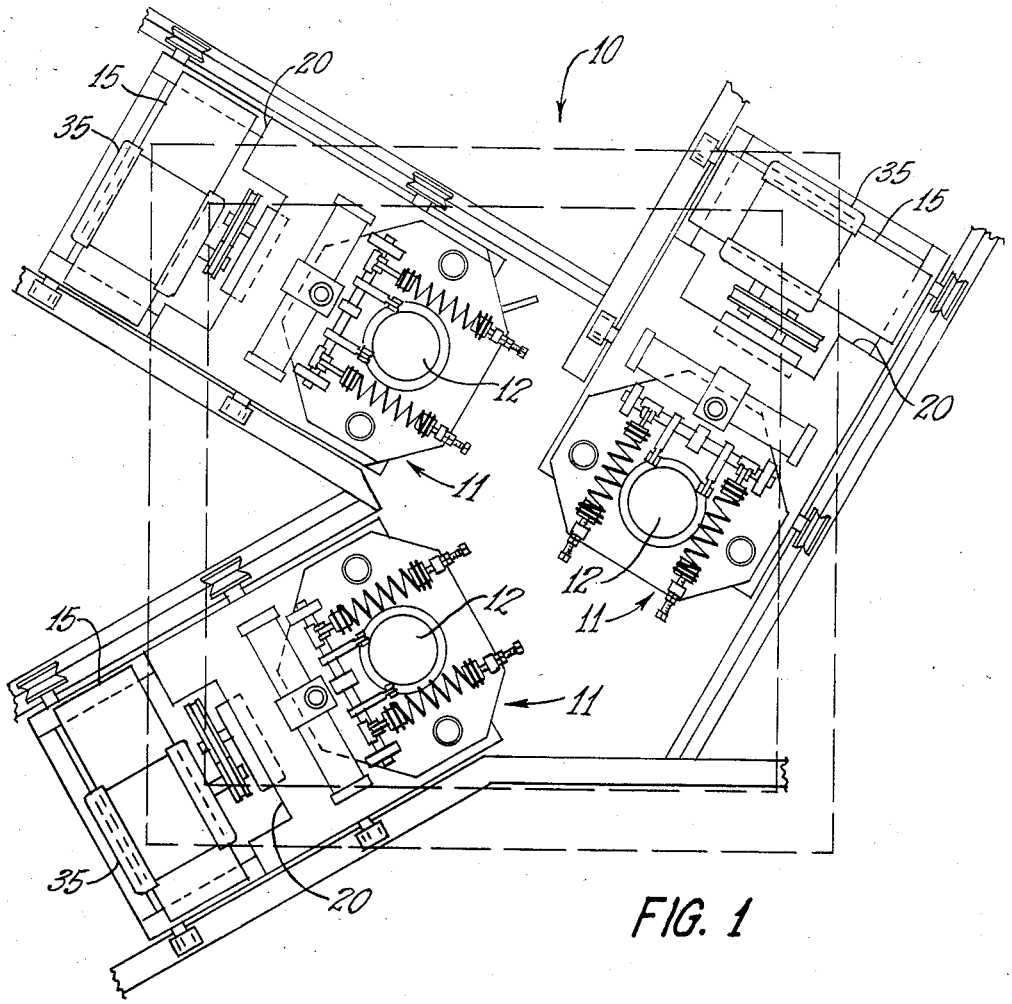
FIG. 1 is a plan view of an arc-type furnace (shown in phantom outline) provided with the electrode retaining apparatus of the present invention.

As illustrated in FIG. 1 of the drawings, the mechanism of the present invention is intended to be utilized in conjunction with an arc melting furnace indicated generally by reference number 10 enclosing a body of molten material. The molten material within the furnace 10 may be molten basalt, molten glass, molten metal or any other molten material. Superimposed over the furnace 10 are a plurality of electrode-supporting mechanism 11 of the present invention, preferably three in number, each retaining a vertical electrode 12 depending into the furnace. The electrodes 12 preferably are of the consumable-type and typically may comprise a cylindrical rod of pre-baked carbon, and preferably each electrode comprises a plurality of sections interconnected by suitable means, as by conventional screw threads. The devices of the present invention overlie the furnace and are supported on support channels 13 which are positioned above the furnace, one pair of channels 13 being provided for each device 11.

Figure 4:
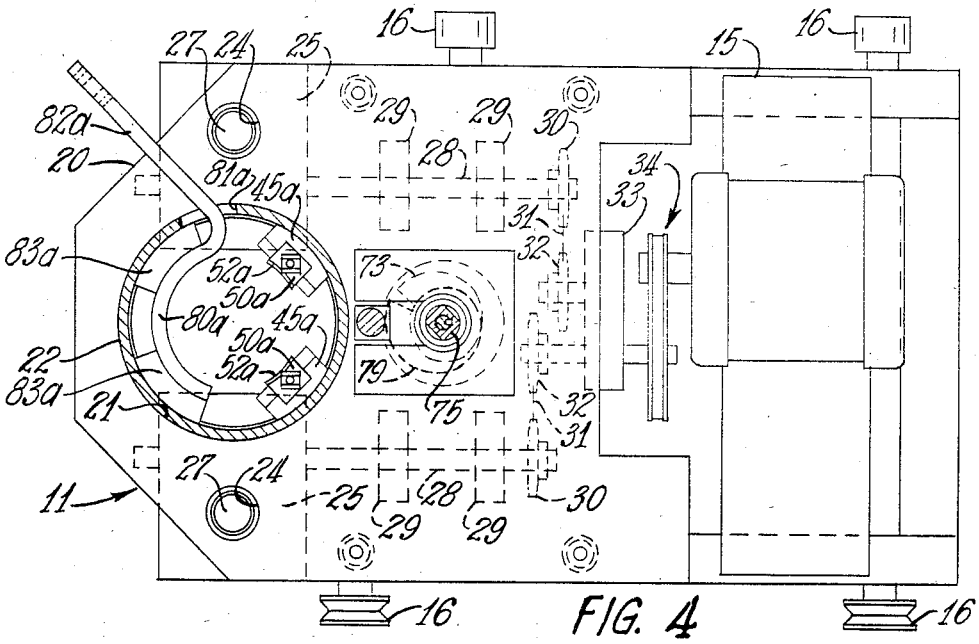
FIG. 4 is an enlarged sectional view taken along the plane 4—4 of FIG. 2.

The devices 11 each include a carriage comprising a pair of longitudinal base rails 14 joined by a mounting plate 15 and a base plate 20, each base rail 14 carrying rollers 16 engageable with the upper flanges of the channels 13. The rails 14 carry lower extensions 17 carrying stabilizer rollers 18 contacting the inner surface of the channels 13 to prevent tipping of the carriage on the channels 13. The base plate 20 is carried by the side rails 14, the base plate 20 being elevated above these side rails and of generally rectangular configuration as indicated in FIGS. 1 and 4. The base plate 20 is mounted on the rails 14 by insulating connectors 20*a* which electrically isolate the rails 14 and the channels 13 from the base plate 20. The carriage, including the rails 14 and the plates 15 and 20, is movable along the channels 13 to alternately position the carriage in an operating position overlying the furnace 10 or in a retracted maintenance position.

The base plate 20 is provided adjacent its outboard end with a vertical aperture 21, and an upstanding, cylindrical support collar 22 is fixed, as by welding, in the aperture 21 to project upwardly therefrom. A support plate 23 is secured to the upper end of the collar 22, this top support plate 23 being of irregular octagonal configuration, as best shown in FIG. 5 of the drawings.

Secured to the undersurface of the plate 20 adjacent the outer edges thereof are a pair of housings 25 forming a part of a commercially available screw jack assembly 26, such screw jack assemblies being commercially available under the trade designation Joyce Gridland Model WJ815, manufactured and sold by the Joyce Gridland Corporation. Each screw jack assembly 26 includes a vertically extending screw 27 engaged by a nut (not shown) enclosed within the housing 25 and operable to threadedly engage the screw 27 for displacing the screw vertically. The nut for each of the screw jack assemblies 26 is driven by a horizontal driveshaft 28 (FIGS. 2 and 4) supported in bearings 29 depending from the base plate 20. The shafts 28 carry sprockets 30 driven by chains 31 lapping drive sprockets 32. The drive sprockets 32 are, in turn, driven by a parallel shaft drive enclosed within housing 33 and having its input driven by a V-belt drive assembly 34 energized by an alternating current, reversible electric motor 35.

Figure 5:
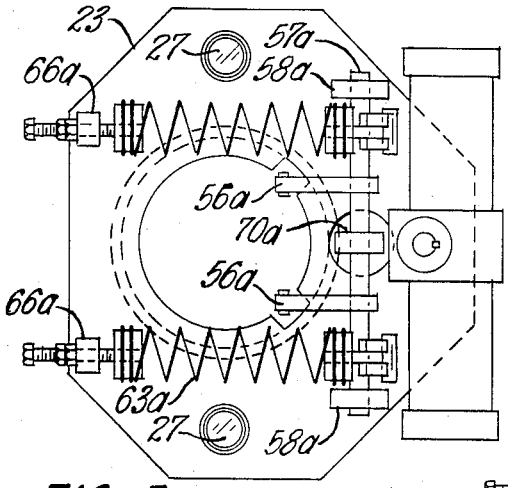
FIG. 5 is a fragmentary enlarged plan view showing the slip actuating mechanism.

The lower ends of the screws 27 are secured within upstanding cylindrical bosses 39 mounted on a lower support plate 43 of substantially the same irregular octagonal configuration as the top plate 23 of FIG. 5. It will be understood that energization of the motor 35 drives the shafts 28 through the drive trains 30–34, and the driveshafts 28, in turn, drive the screws 27 in the appropriate rotational direction to move the lower support plate 43 up or down relative to the support plate 20 and the top plate 23. The lower support plate 43 is carried by a lower base plate 40 which is apertured, as at 41 and an upstanding embossment 42 projects into the aperture 41 to be fixedly secured therein, as heretofore described in connection with the cylindrical housing 22 attached to the upper base plate 20. The cylindrical housing 42 is surmounted by the top support plate 43 similar to the top plate 23. The lower plate 40 is vertically aligned with the upper base plate 20, with the plate apertures 21 and 41 in registry.

Figure 2:
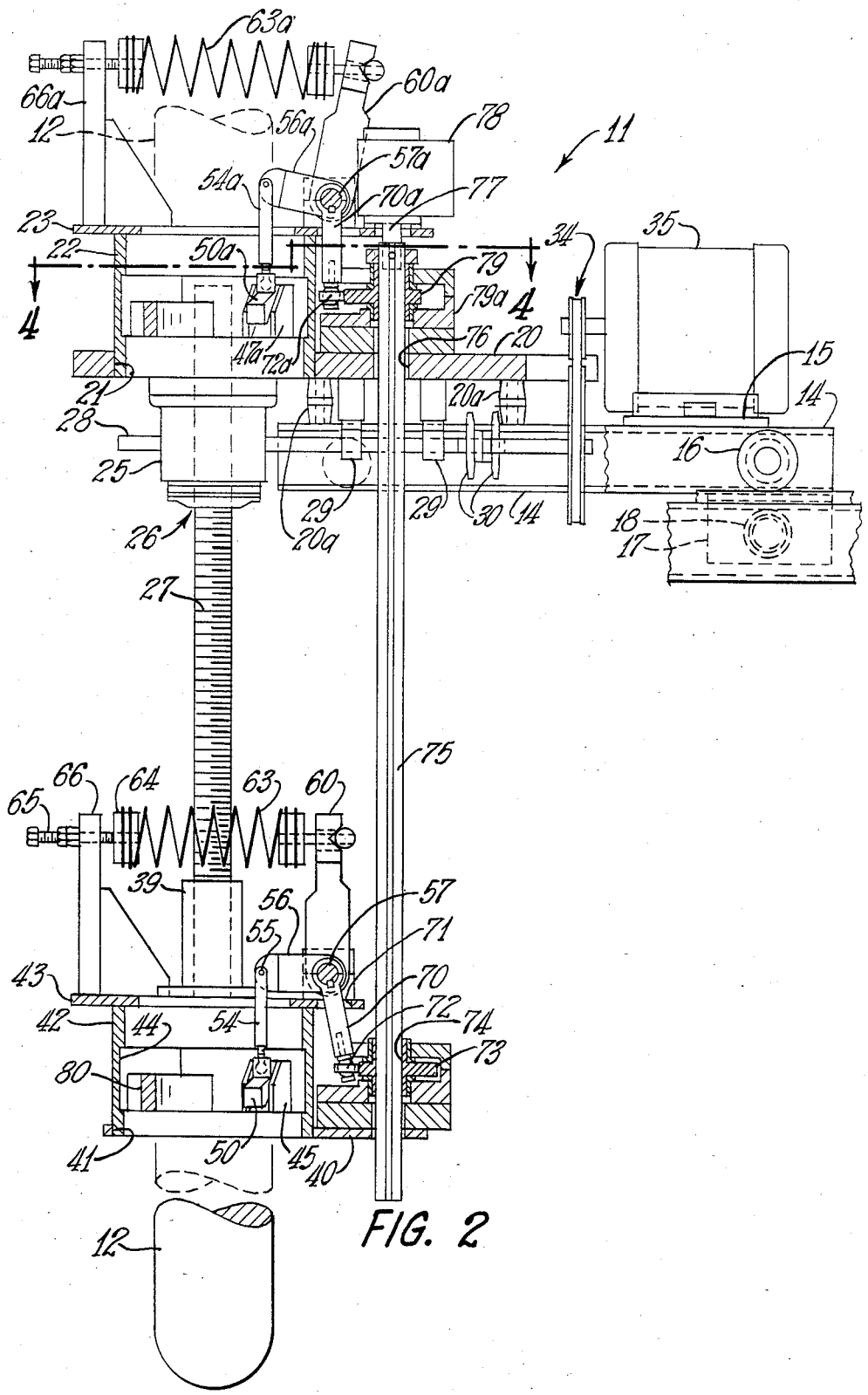
FIG. 2 is a vertical sectional view of the apparatus of the present invention taken along the plane 2—2 of FIG. 3.
Figure 3:
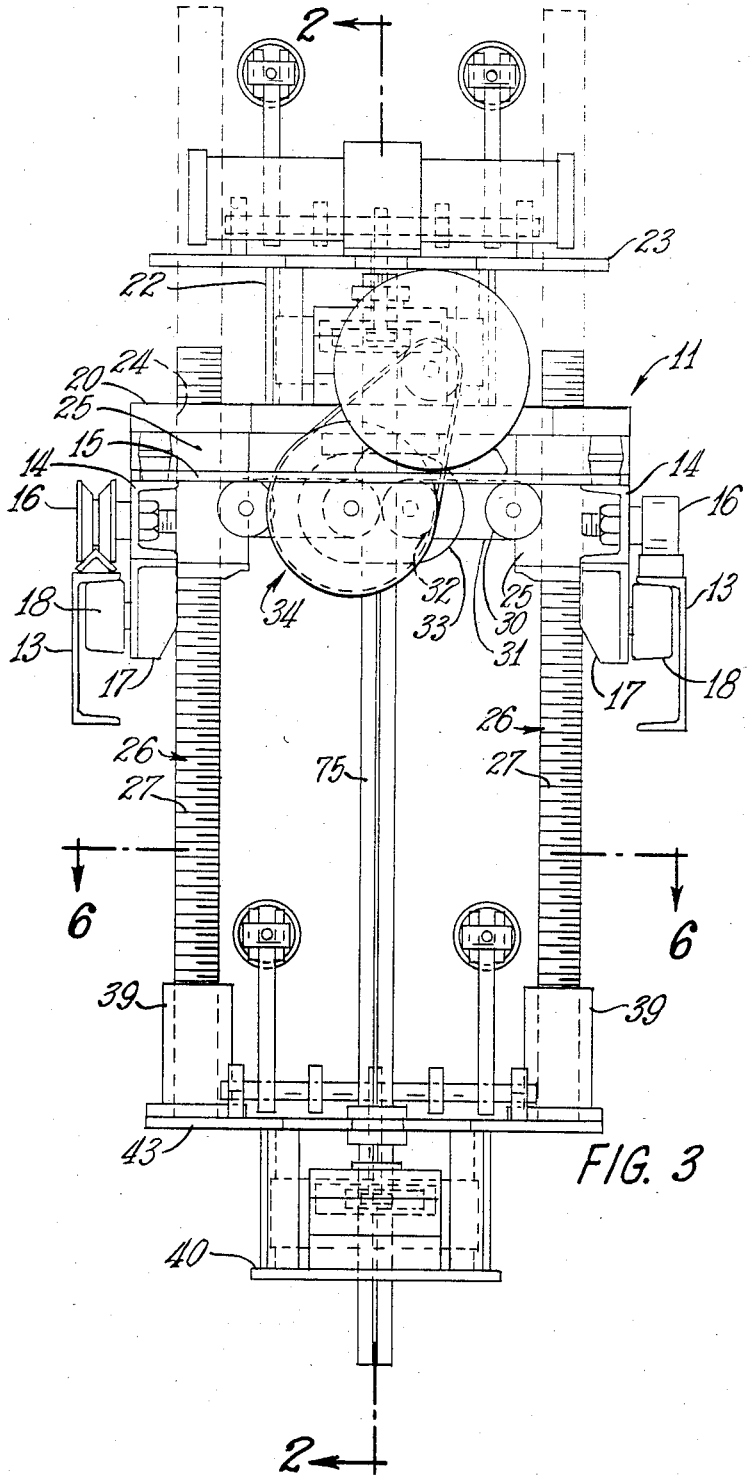
FIG. 3 is a rear elevational view of the apparatus of the present invention.
Figure 7:
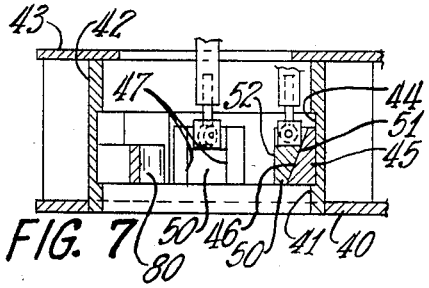
FIG. 7 is a sectional view taken along the plane 7—7 of FIG. 6.
Figure 6:
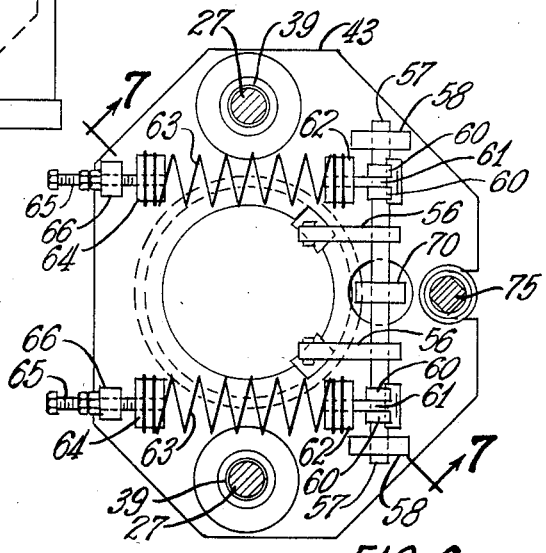
FIG. 6 is an enlarged plan view taken along the plane 6—6 of FIG. 3.

As best shown in FIGS. 2, 6 and 7 of the drawings, the inner periphery of the cylindrical element 42 has a medially located, radially enlarged recess 44 and positioned within this recess is a pair of slide blocks 45, each block 45 having an inwardly facing surface 46 which is downwardly and inwardly inclined. As can be seen from FIG. 7, the inclined surface 46 is recessed into the block 45, so that the block 45 provides side guide surfaces 47 on either side of the inclined surface 46. A retaining slip 50 is positioned in each guide block 45 for vertical movement relative thereto as restrained by the guide surfaces 47.

Each slip 50 is confined between the side surfaces 47 of the adjacent block 45, and each slip has an inclined exterior surface 51 (FIG. 7) which mates with the inclined surface 46 and an exterior arcuate surface 52 adapted to contact an electrode projecting through the plate aperture 41 and the cylindrical element 42. Each slip 50 is adjustably secured to an elevating rod 54 which is pivoted, as at 55, to an actuating link 56 co-rotatable with a shaft 57 journalled in bearing supports 58 fixed to the upper surface of the plate 43.

Also secured to the shaft 57 is an upstanding lever arm 60 which is bifurcated at its upper end to receive therebetween a T-shaped connector 61. The head of the T-shaped connector 61 is entered in notches formed on the outside surface of the bifurcated lever 60, and the stem of the connector 61 is secured to a spring block 62. The spring block 62 retains one end of a tension spring 63, the other end of the tension spring 63 being connected by a second block 64. The tension of the spring 63 can be varied by an adjustment screw 65 projecting through a fixed upstanding arm 66 secured at its lower end to the plate 43.

A cam link 70 has its upper end keyed or otherwise fixedly secured to a medial portion of the shaft 57 (FIGS. 2 and 6), and this cam link 70 depends through an aperture 71 in the plate 43 to terminate in a lower roller-type cam follower 72. The cam follower 72 contacts the exterior periphery of a helical cam 73 which is slidably mounted upon a vertically extending camshaft 75 projecting upwardly from the plate 40 and through an aperture 76 in the support plate 20. The upper end of the camshaft 75 is co-rotatably connected to the oscillatable output shaft 77 of a rotary actuator 78 mounted upon the top plate 23. The rotary actuator is commercially available from Flow Torque Corporation of Orville, Ohio under the designation Flow Torque Model No. A10,000.

The rotary actuator 78 is air-actuated from a source of compressed air (not illustrated) to oscillate the camshaft 75 through an arc of about 180° in either direction. As best illustrated in FIGS. 2 and 6, the camshaft 75 is polygonal in shape, and the cam 73 has a correspondingly polygonal central aperture 74 receiving the camshaft. The cam 73 slides telescopically and axially along the camshaft 75 as the plate 40 is elevated and lowered by the jackscrew assemblies 26. Mounted adjacent the upper end of the camshaft 75 is a second cam 79 enclosed within a housing **79*a* secured to the support plate 20. The cam 79 is of the same contour as the cam 73 and is provided with a polygonal aperture receiving the camshaft 75 therethrough. When assembled on the camshaft 75, the cam 79 is about 180° offset from the cam 73**.

The cam 78 contacts a follower **72*a* identical to the follower 72 described in connection with the cam 73 and the follower 72*a* is mounted on an arm 70*a* identical to the arm 70 earlier described. The upper plate 23 supports the shaft 57*a* provided with an actuating arm 56*a*, a slip link 54*a* and slips 50*a* confined in blocks 45*a* identically as described in connection with these elements associated with the lower plate 40. Similarly, the upper plate 23 carries a spring 63*a* and the associated parts 60*a*–66*a* identical with the parts 60–66 described in connection with the plate 43**.

Also positioned within the lower cylindrical element 42 is an arcuate electrical contact 80 carried by the lower plate 40 and an identical contact **80*a* carried by the upper plate 20. As best seen in FIG. 4, this electrical contact 80*a* is mounted on support blocks 83*a* at the inner periphery of the cylindrical support 22. The contact 80*a* is positioned in opposition to the arcuate inner surfaces of the slips 52*a* of the slips 50*a* and is deflected through an aperture 81*a* in the cylindrical element 22 to provide an extension 82*a*** for connection to a suitable source of electrical power for the electrode.

The operation of the device of the present invention is substantially the same as the operation of that apparatus illustrated and described in our pending application Ser. No. 342,870. The electrode 12 projects through the apertured upper support plate 20 and the cylindrical element 22 downwardly through the plate 43 and the cylindrical element 42 carried by the lower plate 40. The electrode normally is engaged by the slips 50 carried by the lower plate 40 when those slips are positioned as illustrated in FIG. 2 of the drawings. The slips 50, when in their lowered position, contact the exterior periphery of the electrode 12 to urge it against the arcuate interior face of the contact 80 by which electric current is supplied to the electrode. At this time, the slips **50*a* carried by the upper plate 20 are elevated by the cam 79 against the bias of the tension spring 63*a*, so that the slips are out of contact with the electrode and the electrode is not urged against the arcuate contact element 80*a*. Thus, the electrode is retained by the lower slips 50 under the biasing force of the tension spring 63, and the electrode is adjusted vertically in accordance with the position of the plate 40 as the plate 40 is positioned by the jackscrew assemblies 26**.

In our earlier patent application, Ser. No. 342,870, we have described the control circuit for actuating the screws 27 by means of the motor 35 and the operation of the mechanism to vertically adjust the electrodes during operation of the furnace and to reset the lower electrode-engaging mechanism. The apparatus of the present invention operates similarly, with the improvements of replacing the difficulty alignable cantilevered arms with the above-described jackscrew suspension system and the novel cam-actuated slip system for electrode retention. The overlapping of the cams as retained on the common camshaft also ensures that the upper retaining slips engage the electrode before it is released from the lower slips, and vice versa.

We claim:

1. An electrode support for an arc-type furnace comprising a fixed upper support plate having a generally cylindrical upper electrode-receiving passage, a lower support plate underlying the upper support plate and having a vertical electrode-receiving passage therethrough a vertical registry with the passage of said upper support, means adjustably suspending said lower support plate from said upper support plate for vertical movement relative to said upper support plate, an electrode-engaging retaining means carried by said upper and lower support plate, respectively, and projecting into said passages for engagement with an electrode positioned in said apertures, respectively, means for alternately engaging said electrode-engaging means with said electrode to support said electrode from either support plate, and a linearly movable support carriage carrying said upper support plate and alternately positionable in an operative position overlying the furnace and a retracted non-operative maintenance position.

2. An electrode support as defined in claim 1 wherein the means for suspending the lower support plate comprises a pair of jack screws constituting the sole support and guide for said lower plate and means mounted on said upper plate for driving said screws.

* * * * *